US011000115B2

(12) United States Patent
Baker

(10) Patent No.: US 11,000,115 B2
(45) Date of Patent: May 11, 2021

(54) FLEXIBLE FINGER TOOTHBRUSH

(71) Applicant: Grace Baker, Saint Augustine, FL (US)

(72) Inventor: Grace Baker, Saint Augustine, FL (US)

( * ) Notice: Subject to any disclaimer, the term of this patent is extended or adjusted under 35 U.S.C. 154(b) by 0 days.

(21) Appl. No.: 16/544,861

(22) Filed: Aug. 19, 2019

(65) Prior Publication Data

US 2021/0052062 A1 Feb. 25, 2021

(51) Int. Cl.
*A46B 5/04* (2006.01)

(52) U.S. Cl.
CPC ..... *A46B 5/04* (2013.01); *A46B 2200/1066* (2013.01)

(58) Field of Classification Search
CPC ..... A46B 5/04; A46B 2200/1066; A46B 2200/1086
See application file for complete search history.

(56) References Cited

U.S. PATENT DOCUMENTS 1,965,009 A 7/1934 Stevens
2,018,903 A * 10/1935 Stevens ..... A46B 5/04 15/188
2,077,540 A * 4/1937 Welker ..... A46B 5/04 401/7
4,617,694 A 10/1986 Bori
5,213,428 A 5/1993 Salman
5,287,584 A 2/1994 Skinner
5,348,153 A 9/1994 Cole
5,392,482 A * 2/1995 Drulias ..... A46B 5/04 15/104.94
5,502,863 A 4/1996 Perkins
5,819,765 A * 10/1998 Mittiga ..... A46B 5/04 132/309
5,826,599 A 10/1998 Adams
10,117,506 B2 * 11/2018 Crowley ..... A46B 5/04
2016/0255948 A1 * 9/2016 Capozza ..... A46B 9/045

FOREIGN PATENT DOCUMENTS

WO WO2001074196 10/2001

* cited by examiner

*Primary Examiner* — Randall E Chin
(74) *Attorney, Agent, or Firm* — Law Office of Mitchell Ghaneie, P.A.; Mitchell Ghaneie; Christopher Roberts

(57) ABSTRACT

This invention is a flexible finger toothbrush that provides traditional toothbrush bristles and is intended to be used by caregivers providing oral care to patients at bedside. Due to the difficulty in brushing another's teeth from bedside, this device allows for the caregiver to place the flexible toothbrush on her or his finger and assist the caregiver in understanding the placement of the bristles relative to the patient's teeth. Accordingly, this device enables a caregiver to consistently brush a patient's teeth at the recommended 45-degree angle, thereby providing better oral care to patients.

12 Claims, 4 Drawing Sheets

FLEXIBLE FINGER TOOTHBRUSH

BACKGROUND OF THE INVENTION

A. Field of the Invention

This invention is related to a toothbrush that fits over the finger of a user and can be utilized to brush the user's teeth or the teeth of another individual.

B. Prior Art

Hospitals, nursing homes, rehabilitation centers, and other establishments that provide care to the elderly, disabled, or sick are tasked with ensuring that each patient is taken care of. In some instances, patients require long term care, which includes providing oral care such as, wetting the patients lips to prevent cracking in the skin as well as occasionally brushing of the patient's teeth. Today, care takers use a sponge swab to provide oral care.

The sponge swab is essentially comprised of a sponge that is attached to one end of a stick. The other end of the stick that is not attached to the sponge is to be held by the caregiver during application of the sponge on a patient. The sponge is used to clean and moisten a patient's mouth, teeth, and gums. However, the sponge is relatively limited when applied for cleaning teeth and gums because the sponge material is prone to tearing.

Furthermore, the patient is commonly in a hospital bed laying down or in a reclined position during application of the sponge. Consequently, the patient's position can make it difficult for the caregiver to carefully brush the patient's teeth and gums because she or he must apply the sponge at bedside by holding the stick in the patient's mouth. Accordingly, the caregiver must apply the sponge swab with limited visibility as to where the sponge is being applied on each tooth.

The present device solves these issues by enabling the caregiver to provide oral care at a patient's bedside by placing the toothbrush on her or his finger and placing the bristles of the brush on the patient's teeth. The present device provides indicators to assist the user in determining the position of brush head relative to the patient's gumline while brushing the patient's teeth. In turn, this device assists caregivers with accurately using the brush on her or his patient's teeth and consistently providing better oral care for those patients.

BRIEF SUMMARY OF THE INVENTION

This device is a flexible toothbrush that slides over a user's finger and can bend when the user desires to bend his or her finger. This toothbrush is comprised of a sleeve, a plurality of indicators, a bristle holder that is attached to the sleeve and a plurality of bristles that are attached to the bristle holder. This device is described as providing each indicator at substantially a 90-degree angle from each other and at least one indicator of the plurality is located 45-degrees from the center of the bristle holder. The positioning of the indicators allows the caregiver to visually identify where the bristles of the brush are relative to the patient's gumline.

The sleeve of the brush is intended to be flexible and, thus provide the caregiver with a high level of control during use. However, due to the sleeve's flexibility and the desire to brush the patient's teeth a 45-degree angle relative to the patient's gumline, a grip is provided on the interior surface of the sleeve. The grip assists with preventing the sleeve from torsion, while still enabling it to bend as desired by the caregiver.

NUMBER REFERENCES

5—Device
10—Sleeve
15—Indicator
15*a*—First surface
15*b*—Second surface
20—Plurality of bristles
25—Bristle holder
30—Grip

DETAILED DESCRIPTION

Figure 6:
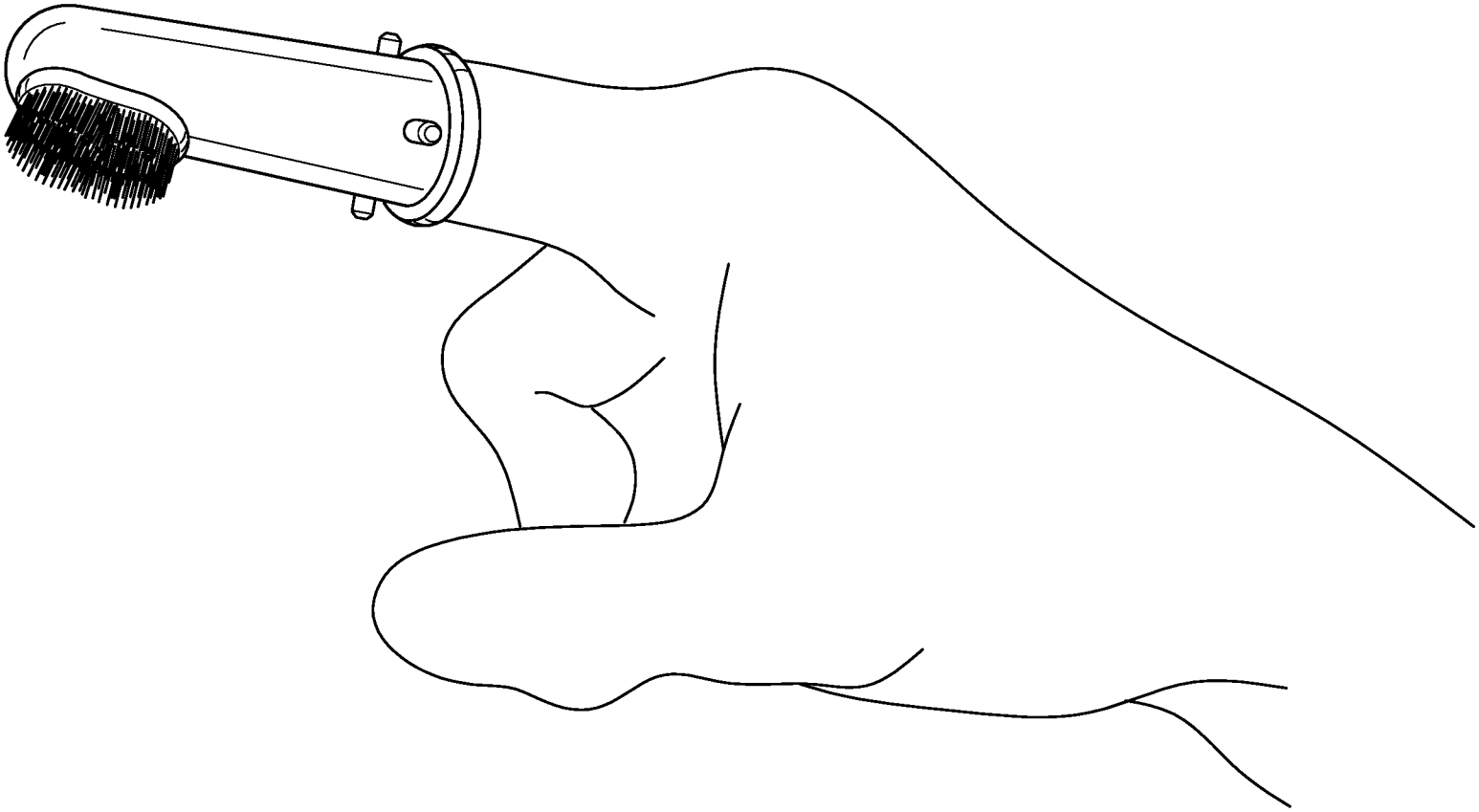
FIG. 6 is an in-use view, which shows the device placed on the finger of a user.

This device 5 is a finger toothbrush comprised of a sleeve 10, at least one indicator 15, a plurality of bristles 20, a 4 bristle holder 25, and a grip 30. The sleeve 10 provides a first end, a second end, an interior surface, and an exterior surface. The bristle holder 25 is attached at the first end of the sleeve 10 and the second end of the sleeve provides an opening. Also, at least one indicator is provided at the second end of the sleeve 10. As shown in FIG. 6, the opening in the sleeve 10 is to be large enough to fit the end of a person's finger into it. The sleeve 10 is made of a flexible material, which allows for an individual to still move his or her finger while it is placed in the sleeve 10 and ensure the sleeve 10 friction fits onto the user's finger. It is anticipated that the sleeve 10 can be made from a flexible material, such as silicone. It is further anticipated that the plurality of bristles 20 may also be made of silicone and provided as an integral component of the sleeve 10.

Because the sleeve 10 is flexible, the bristle holder 25 is attached to the sleeve 10, which provides an area for the plurality of bristles 20 to be attached to. The plurality of bristles 20 is anticipated to be made from a coarse material such as a plurality of nylon strands. Connecting the bristle holder 25 to the plurality of bristles 20 ensures the plurality of bristles 20 stay attached to the device 5 while the device 5 is in use.

Figure 1:
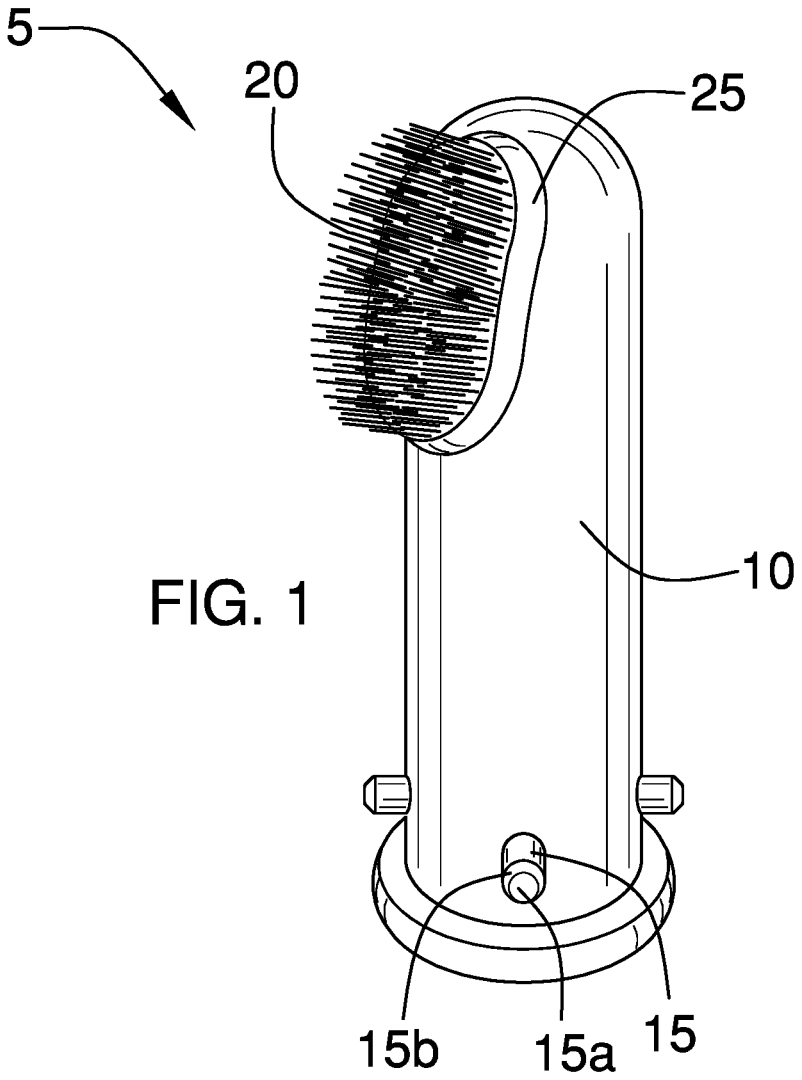
FIG. 1 is a front isometric view of the device, which shows the sleeve, a plurality of indicators, a first indicator surface, a second indicator surface, a bristle holder, and a plurality of bristles attached to the bristle holder.
Figure 2:
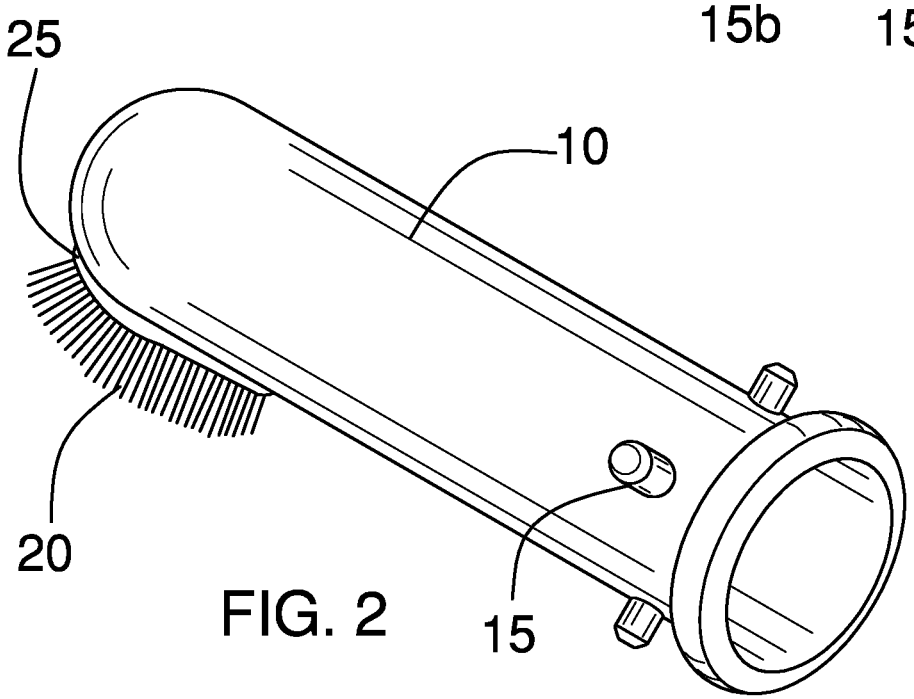
FIG. 2 is a bottom isometric view of the device showing the sleeve, the plurality of indicators, the bristle holder, and the plurality of bristles attached to the bristle holder.
Figure 3:
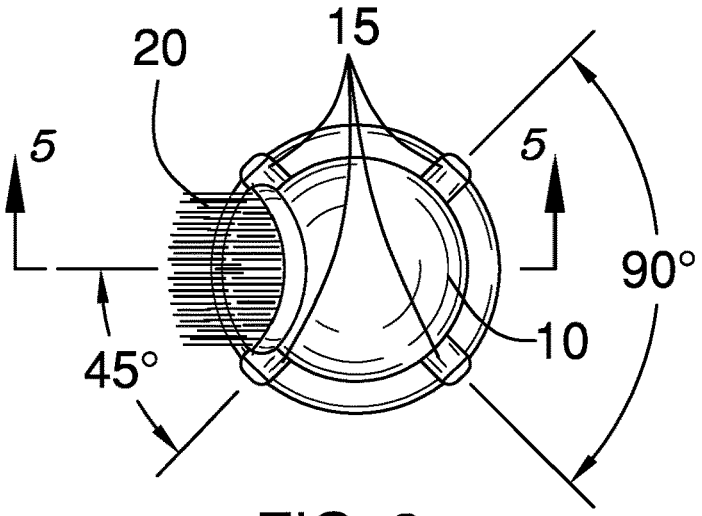
FIG. 3 is a top view of the device showing the sleeve, the plurality of indicators, the bristle holder, and the plurality of bristles attached to the bristle holder.
Figure 4:
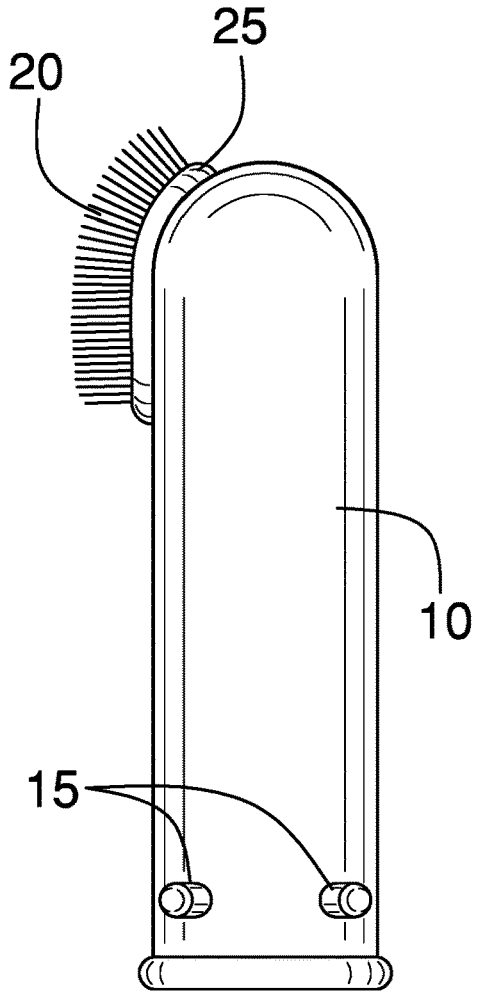
FIG. 4 is a side view of the device showing the sleeve, two indicators, the bristle holder, and the plurality of bristles attached to the bristle holder.

In the present device, it is anticipated that one or more indicators may be provided on the sleeve 10. However, the present invention is described as providing a plurality of indicators 15, where each indicator of the plurality of indicators are provided substantially 90-degrees from one another. Each indicator of the plurality of indicators 15 is further comprised of a first surface 15*a* and a second surface 15*b*. The first surface 15*a* is substantially concentrically located relative to the position of the second surface 15*b*. At least one indicator of the plurality of indicators 15 is provided substantially 45-degrees from the center of the plurality of bristles 20 as shown in FIG. 3. The plurality of indicators 15 protrude outward from the sleeve thereby allowing the user to have a visual and tactile indicator showing where the plurality of bristles 20 is in relation to the patient's gumline. To assist the user in being precisely accurate with using the device 5, the user can view the first surface 15*a* of an indicator being centered within the second surfaces 15*b*.

Brushing the patient's teeth at a 45-degree angle to the gumline is recommended because it allows the bristles to clean the sides and top of the teeth as well as between the teeth and the gums of the patient. Accordingly, the caregiver may place the plurality of bristles 20 on the patient's teeth and rotate her or his finger accordingly such that an indicator is perpendicular to the side of patient's gumline. Thus, when the caregiver begins brushing, the plurality of bristles would be contacting the respective teeth at a 45-degree angle. Consequently, the caregiver is provided with a visual indicator which assists to ensure consistent brushing of the patient's teeth at a 45-degree angle.

The presently described device provides a plurality of indicators 15 so the user may have a visual indicator to view when she or he brushes both the top teeth and the bottom teeth. Also, providing a providing a plurality of indicators 15 allows the indicators to be viewed when the toothbrush is used by right hand dominate individuals and left hand dominate individuals.

Figure 5:
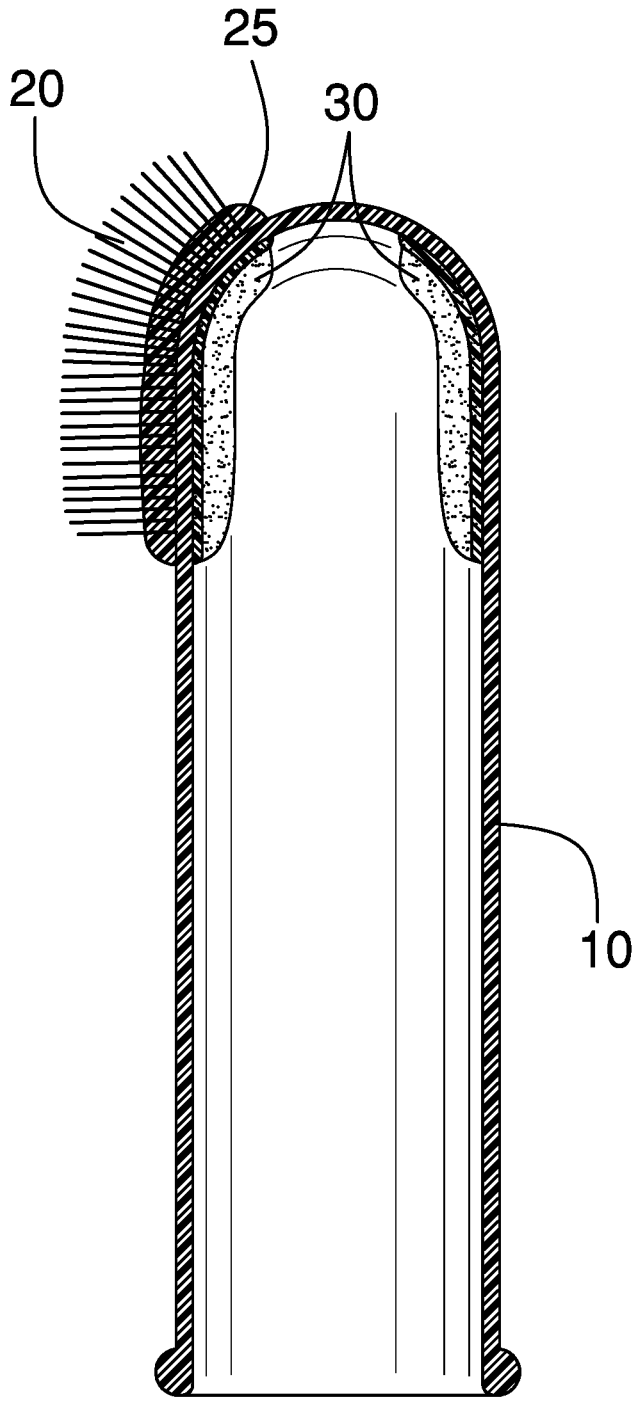
FIG. 5 is a cross-sectional view of FIG. 3 which shows the sleeve, the bristle holder, the plurality of bristles attached to the bristle holder, and a grip surface located on the interior of the sleeve.

As FIG. 5 shows, the toothbrush provides a grip 30 on the interior surface of the sleeve 10. Because the sleeve 10 is made from a flexible material and the plurality of bristles are applied at a 45-degree angle, the toothbrush may be prone to torsion during use. The grip 30 allows the caregiver to have greater control over the first end of the sleeve 10, thereby increasing the torsional resistance of the sleeve 10 while it is in use. In other words, the grip 30, enables the caregiver to apply the plurality of bristles 20 at a 45-degree angle, while also maintaining the ability to use the appropriate force for brushing the patient's teeth.

While the embodiments of the invention have been disclosed, certain modifications may be made by those skilled in the art to modify the invention without departing from the spirit of the invention.

The inventor claims:

1. A toothbrush, which is comprised of:
- a. a sleeve;
  - wherein the sleeve has a first end and second end;
  - wherein the sleeve provides an interior surface and an exterior surface;
  - wherein the sleeve is closed at the first end;
  - wherein the sleeve provides an opening at the second end;
- b. a bristle holder;
  - wherein the bristle holder is affixed to the exterior surface of the sleeve;
  - wherein the bristle holder is provided substantially at the first end of the sleeve;
- c. a plurality of bristles;
  - wherein the plurality of bristles is attached to the bristle holder;
- d. a plurality of indicators;
  - wherein at least one indicator of the plurality of indicators is provided substantially 45-degrees from the center of the plurality of bristles;
  - wherein each indicator provides a first surface and a second surface;
  - wherein the first surface is substantially concentrically provided within the second surface.

2. The toothbrush as described in claim 1, wherein a grip is provided on the interior surface of the sleeve.

3. The toothbrush as described in claim 2, wherein the grip is provided substantially at the first end of the sleeve.

4. The toothbrush as described in claim 2, wherein the grip is integral to the sleeve.

5. The toothbrush as described in claim 1, wherein each indicator of the plurality of indicators are substantially 90-degrees from one another.

6. A toothbrush, which is comprised of:
- a. a sleeve;
  - wherein the sleeve has a first end and second end;
  - wherein the sleeve provides an interior surface and an exterior surface;
  - wherein the sleeve is closed at the first end;
  - wherein the sleeve provides an opening at the second end;
- b. a grip;
  - wherein the grip is provided on the interior surface of the sleeve;
- c. a bristle holder;
  - wherein the bristle holder is affixed to the exterior surface of the sleeve;
  - wherein the bristle holder is provided substantially at the first end of the sleeve;
- d. a plurality of bristles;
  - wherein the plurality of bristles is attached to the bristle holder;
- e. a plurality of indicators;
  - wherein at least one indicator of the plurality of indicators is provided 45 degrees from the center of the plurality of bristles;
  - wherein each indicator provides a first surface and a second surface;
  - wherein the first surface is substantially concentrically provided within the second surface.

7. The toothbrush as described in claim 6, wherein each indicator of the plurality of indicators are substantially 90-degrees from one another.

8. The toothbrush as described in claim 6, wherein the grip is provided substantially at the first end of the sleeve.

9. The toothbrush as described in claim 6, wherein the grip is integral to the sleeve.

10. A toothbrush, which is comprised of:
- a. a sleeve;
  - wherein the sleeve has a first end and second end;
  - wherein the sleeve provides an interior surface and an exterior surface;
  - wherein the sleeve is closed at the first end;
  - wherein the sleeve provides an opening at the second end;
- b. a grip;
  - wherein the grip is provided on the interior surface of the sleeve;
  - wherein the grip is provided at the first end of the sleeve;
- c. a bristle holder;
  - wherein the bristle holder is affixed to the exterior surface of the sleeve;

d. a plurality of bristles;

wherein the plurality of bristles is attached to the bristle holder;

e. a plurality of indicators;

wherein the plurality of indicators are provided on the sleeve;

wherein each indicator of the plurality of indicators is provided substantially 90 degrees from one another;

wherein at least one indicator of the plurality of indicators is provided 45 degrees from the center of the plurality of bristles;

wherein each indicator of the plurality of indicators provides a first surface and a second surface.

11. The toothbrush as described in claim 10, wherein the grip is integral to the sleeve.

12. The toothbrush as described in claim 10, wherein the first surface is substantially concentrically provided within the second surface.

* * * * *